US007350314B2

(12) United States Patent
McCambridge et al.

(10) Patent No.: US 7,350,314 B2
(45) Date of Patent: Apr. 1, 2008

(54) CALIBRATION GAUGE FOR HAIR CUTTER BLADESETS

(75) Inventors: James E. McCambridge, Polo, IL (US); Luther D. Langley, Sterling, IL (US)

(73) Assignee: Wahl Clipper Corporation, Sterling, IL (US)

( * ) Notice: Subject to any disclaimer, the term of this patent is extended or adjusted under 35 U.S.C. 154(b) by 65 days.

(21) Appl. No.: 11/316,447

(22) Filed: Dec. 22, 2005

(65) Prior Publication Data

US 2007/0144025 A1 Jun. 28, 2007

(51) Int. Cl.
*B27G 23/00* (2006.01)

(52) U.S. Cl. ..... 33/633; 33/626

(58) Field of Classification Search ..... 33/633, 33/613, 626, 627, 628, 630, 631, 645; 83/522.11, 83/522.15, 522.16, 522.22, 522.24; 81/177.1, 81/177.2, 177.5; D8/83, 84
See application file for complete search history.

(56) References Cited

U.S. PATENT DOCUMENTS

| | | | | | |
|---|---|---|---|---|---|
| 1,861,616 | A | | 6/1932 | Wahl | |
| D148,621 | S | * | 2/1948 | Herman | D8/22 |
| 2,641,847 | A | * | 6/1953 | McCormick | 33/633 |
| 3,216,471 | A | * | 11/1965 | Wendel | 81/436 |
| 3,816,864 | A | * | 6/1974 | Cotter | 7/164 |
| D245,062 | S | * | 7/1977 | Grame | D8/83 |
| D245,063 | S | * | 7/1977 | Grame | D8/83 |
| D255,091 | S | * | 5/1980 | Kanold | D8/83 |
| D272,982 | S | * | 3/1984 | Rizzo et al. | D8/24 |
| 4,538,356 | A | * | 9/1985 | Knepshield et al. | 33/628 |
| 4,630,378 | A | * | 12/1986 | Kulp et al. | 33/628 |
| 4,669,189 | A | | 6/1987 | Ullmann | |
| 4,700,489 | A | * | 10/1987 | Vasile | 33/342 |
| 4,993,167 | A | * | 2/1991 | Durfee, Jr. | 33/626 |
| 5,967,006 | A | * | 10/1999 | Hillinger | 81/489 |
| 6,397,709 | B1 | * | 6/2002 | Wall | 81/440 |
| 6,604,287 | B2 | | 8/2003 | Melton et al. | |
| 2003/0005585 | A1 | | 1/2003 | Rizzuto, Jr. et al. | |
| 2004/0206215 | A1 | * | 10/2004 | Athanasiou et al. | 81/177.5 |
| 2004/0231471 | A1 | * | 11/2004 | Rottkamp | 81/177.5 |
| 2005/0092142 | A1 | * | 5/2005 | Nish | 81/452 |

FOREIGN PATENT DOCUMENTS

| | | |
|---|---|---|
| GB | 957935 | 5/1964 |

* cited by examiner

*Primary Examiner*—Christopher W Fulton
(74) *Attorney, Agent, or Firm*—Greer, Burns & Crain, Ltd.

(57) ABSTRACT

A blade calibration gauge for a bladeset for a hair cutter has a moving blade laterally reciprocating relative to a stationary blade, where the moving blade and the stationary blade are adjustable relative to one another in a direction normal to a direction of reciprocation. The blade calibration gauge has a base defining a recess configured for receiving the stationary blade and providing a first stop for engaging a toothed edge of the stationary blade, and a second stop on the base disposed relative to first stop for providing a designed offset spacing for a toothed cutting edge of the moving blade relative to the corresponding toothed edge of the fixed blade.

16 Claims, 4 Drawing Sheets

CALIBRATION GAUGE FOR HAIR CUTTER BLADESETS

BACKGROUND OF THE INVENTION

The present invention relates generally hair cutting devices wherein the cutting action is obtained by reciprocating blades such as clippers and trimmers. More specifically, the present invention relates to devices for adjusting the spacing between blades in hair cutting devices (collectively referred to as hair cutters) having a bladeset with a moving blade and a stationary blade.

In such bladesets, the moving blade laterally reciprocates relative to the stationary blade, and the moving and stationary blades are adjustable relative to one another in a direction normal to a direction of reciprocation. The distance between toothed ends of the blades is adjusted by releasing fasteners, which are typically screws, that connect the moving blade to a guide held by the stationary blade, and then adjusting the moving blade to the desired spacing. These screws must be sufficiently tightened so that they will not loosen when the clipper is in use.

For certain types of precision hair cutting and trimming operations, such as detail outlining, or cutting lines or patterns into a person's hair or the edge of the person's hairline, whether facial, scalp or body hair, it is desirable that the distance between the stationary blade and the cutting blade be small as possible. However, the teeth of the moving blade are preferably offset from the stationary blade to avoid cutting the skin of the person whose hair is being cut or trimmed. A balance between precision and skin damage is often the result of blade adjustment. Thus, it is desirable to adjust the moving blade so that it is offset from the stationary blade by a very small distance. Currently, such adjustments are performed by the naked eye, with the user (typically a hair professional) making difficult, precise adjustments to obtain the desired small gap between the toothed blade edges.

In the hair cutting industry, it is typical for manufacturers to set the bladeset spacing at the factory. Through normal use and maintenance, end users often are faced with the task of recalibrating the bladeset spacing. However, the end users were forced to perform such recalibration by eye. This method has obvious drawbacks due to lack of precision and consistency in the adjustment.

Accordingly, there is a need for a device that will facilitate consistent adjustment of blades by end users, among others, to extremely small distances for precision hair cutting operations. There is also a need for a tool usable in the blade adjustment process which is capable of readily tightening a threaded fastener, and generating a significant amount of torque for tightening the fasteners between the blades to maintain the desired spacing during operation.

BRIEF SUMMARY OF THE INVENTION

The above-listed objects are met or exceeded by the present blade calibration gauge that enables consistent, desired adjustment of the distance between the toothed ends of the blades in the bladeset to an extremely small distance. This provides the user with the ability to reliably obtain a smaller, more precise gap between the blade edges than previously possible. The result is more accurate cutting by a hair cutter without causing damage to the subject's skin.

More specifically, a blade calibration gauge is provided for a bladeset for a hair clipper having a moving blade laterally reciprocating relative to a stationary blade, where the moving blade and the stationary blade are adjustable relative to one another in a direction normal to a direction of reciprocation. The blade calibration gauge has a base defining a recess configured for receiving the stationary blade and providing a first stop for engaging a toothed edge of the stationary blade, and a second stop on the base disposed relative to the first stop for providing a designated offset spacing for a toothed cutting edge of the moving blade relative to the corresponding toothed edge of the fixed blade.

In another embodiment, a blade calibration gauge is provided for a bladeset for a hair cutter, the bladeset having a moving blade laterally reciprocating relative to a stationary blade, the moving blade and the stationary blade being adjustable relative to one another in a direction normal to a direction of reciprocation. The blade calibration gauge includes a base having two side sections facing one another connected by a top section, a recess defined between the side sections and the top section, the recess defined by two interior side walls and an interior top wall and having a floor portion between the interior side walls. The interior top wall is defined by lower and upper surfaces offset from one another.

A tool is also provided for use in adjusting removable bladesets for hair clippers, and includes a handle having at least two axially arranged sections, each handle section has a different style of grip.

DETAILED DESCRIPTION OF THE INVENTION

Figure 1:
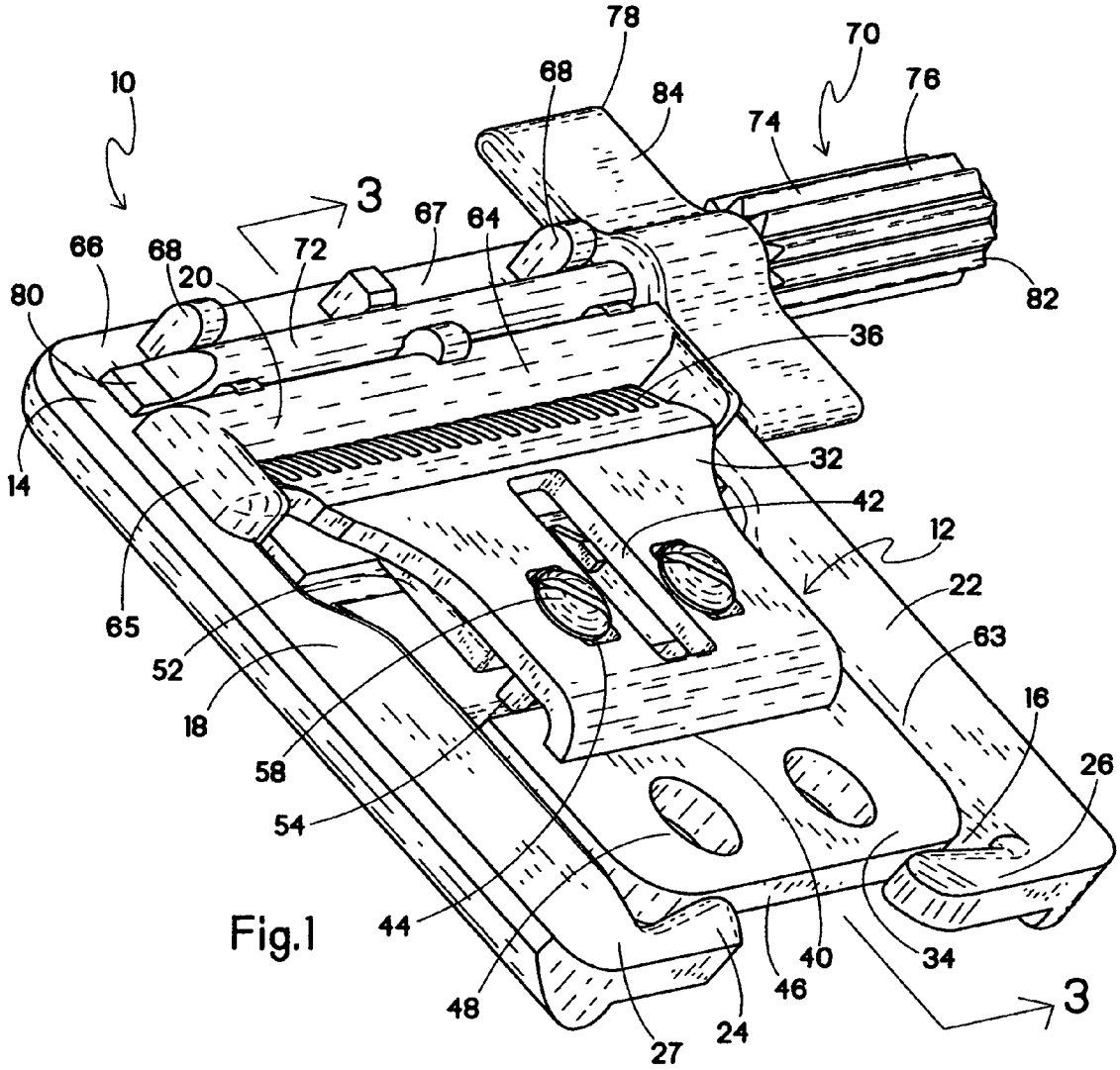
FIG. 1 is a top perspective view of the present blade calibration gauge shown with a retained bladeset.
Figure 2:
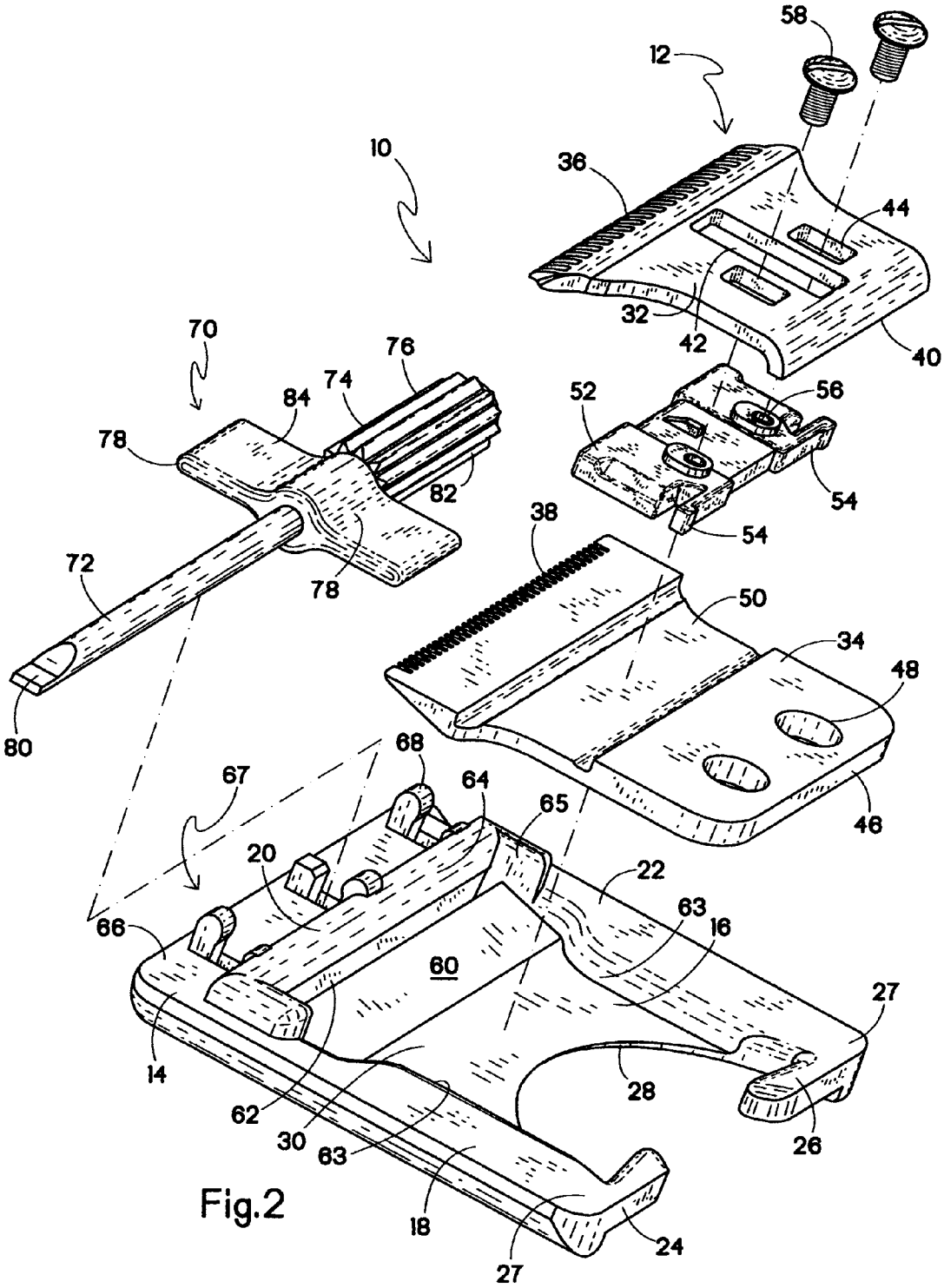
FIG. 2 is an exploded perspective view of the present blade calibration gauge and a bladeset.

Referring to FIGS. 1 and 2, the present blade calibration gauge, generally designated 10 is shown holding a bladeset 12. The bladeset 12 is received by a base 14 in a recess 16 of the blade calibration gauge 10. The recess 16 is defined by a first side portion 18, a top section 20, and a second side portion 22. When viewed from above, the first and second side portions 18, 22 are in generally spaced parallel relationship to each other, and when combined with the top section 20, from a general "U"-shape. Alternate shapes for the recess 16 and the components defining the recess are contemplated as long as the bladeset 12 is securely retained.

Projections 24 and 26 are secured to free ends 27 of the first and second side portions 18, 22 and project normally from the side portions to close off a rear end of the recess 16. Also, the projections 24 and 26 are configured to assert a spring force against a stationary blade against a designated stop, and also to snugly retaining the bladeset in the recess 16. While the preferred projections 24, 26 are integrally molded with the side portions 18, 20 and extend inwardly into the recess 16, other orientations and configurations are contemplated depending on the amount of biasing force required. Projections 24 and 26 are secured to free ends 27 of the first and second side portions 18, 22 and project normally from the side portions to close off a rear end of the recess 16. Also, the projections 24 and 26 are configured to assert a spring force against a stationary blade against a designated stop, and also to snugly retaining the bladeset in the recess 16. While the preferred projections 24, 26 are integrally molded with the side portions 18, 20 and extend inwardly into the recess 16, other orientations and configurations are contemplated depending on the amount of biasing force required.

In FIG. 2, the recess 16 includes a D-shaped cutout 28 for finger access to the bladeset 12 for releasing the bladeset from the recess once adjustments in blade positioning are made. Also included in the recess 16 is a floor portion 30 which provides support for the bladeset 12 (best seen in FIG. 3).

As is known in the art, the bladeset 12 includes a moving blade 32 and a stationary blade 34, each having a corresponding toothed edge 36, 38. The cutting action in the present bladeset 12 is obtained by the moving blade 32 laterally reciprocating relative to the stationary blade 34. Opposite the toothed edge 36 on the moving blade 32 is a rear end 40, and a drive slot 42is located generally centrally on the moving blade. The drive slot 42 is constructed and arranged for receiving a driving member (not shown) of the hair cutter drive system, which moves to generate the lateral reciprocating motion of the moving blade 32. On either side of the drive slot 42 is located a mounting opening 44.

Referring now to the stationary blade 34, opposite the toothed edge 38 is a grip end 46 adjacent to which are located at least one and preferably two mounting apertures 48 for securing the bladeset 12 to a cutter as is well known in the art. Between the toothed edge 38 and the grip end 46 is located a transverse track or indentation 50. A guide 52 is slidably disposed in the track 50 and preferably includes at least one and preferably two biased arms 54 for exerting a biasing force on the track 46 for maintaining the position of the guide during cutter operation.

Included on the guide 52 is at least one and preferably a pair of preferably threaded bores 56 disposed to be in registry with the mounting openings 44 on the moving blade 32. Releasable fasteners 58, preferably threaded screws, secure the moving blade 32 to the guide 52, and in so doing provide the capability of adjusting the position of the moving blade relative to the stationary blade 34. As is known in the art, upon assembly into a hair cutter, a spring (not shown) typically urges the moving blade 32 against the stationary blade 34 for pressing the adjacent cutting edges together in a tight, sliding relationship.

The mounting openings 44 are relatively elongate in a direction normal to the toothed edge 36 to permit the adjustability of the moving blade in a direction normal to the direction of reciprocation. As described above, the projections 24, 26 contact the grip end 46 of the stationary blade 34 to urge it toward a stop, described below. While the present bladeset 12 is shown in a configuration where the moving blade 32 is adjustable relative to the fixed blade 34, it is contemplated that the present blade calibration gauge 10 is readily modifiable for use with bladesets in which the fixed blade is movable relative to the moving blade.

Figure 3:
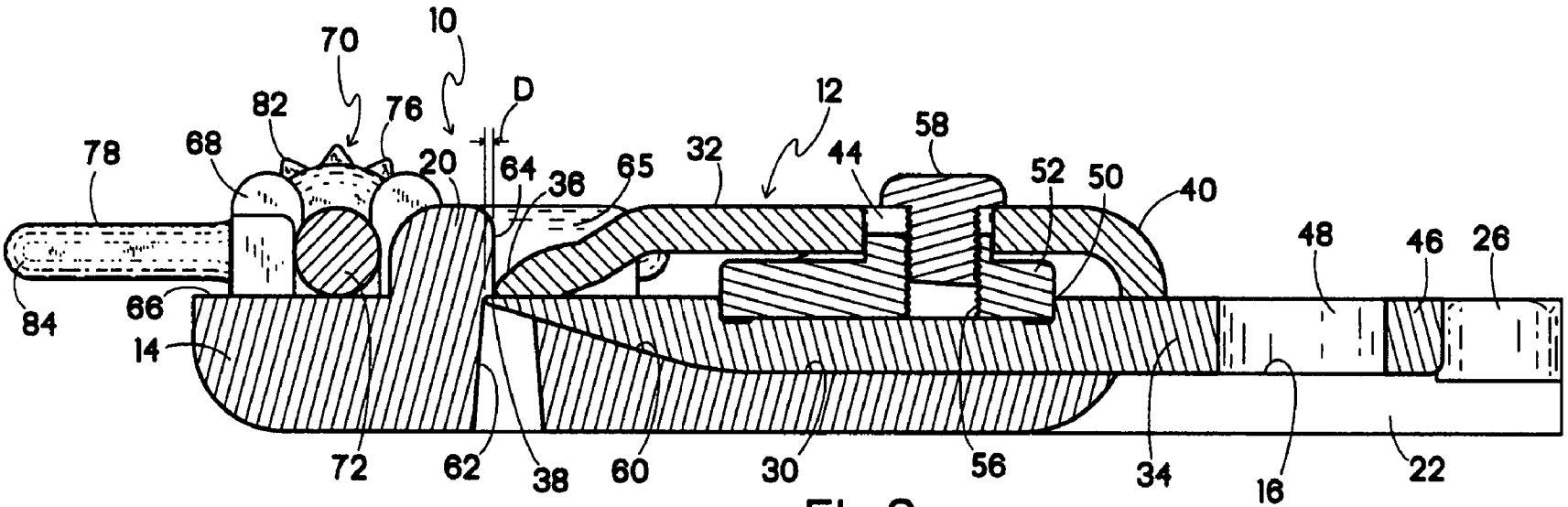
FIG. 3 is a cross-section taken along the line 3-3 of FIG. 1 and in the direction generally indicated.

Referring now to FIGS. 2 and 3 and returning to the blade calibration gauge 10, the recess 16 is dimensioned to tightly accommodate the stationary blade 34 so that the blade is supported or cradled on the floor portion 30. As such, the floor portion 30 includes an upwardly inclined portion 60 which extends toward a lower interior top wall 62 of the base 14. The lower interior wall 62 is a continuation of the top portion 20, helps define the recess 16 and serves as a first stop for the toothed edge 38 of the stationary blade.

For ease of access, the recess 16 is dimensioned to be slightly longer than the stationary blade 34, and the projections 24, 26 exert sufficient biasing force against the grip end 46 to urge the stationary blade toward the lower interior wall 62. Also, the first and second side portions 18, 22 each preferably have interior walls 63 which also contribute to the definition of the recess 16 and receive corresponding side edges of the stationary blade 34.

Also included on the base 14 is an upper interior top wall 64, also part of the top portion 20 and which serves as a second stop for the toothed edge 36 of the moving blade 32. As seen in FIG. 3, bladeset-facing edges of the top wall 64 and the lower interior top wall 62 are offset from each other a distance "D" which represents the desired offset of the toothed edge 36 from the toothed edge 38. In the preferred embodiment, the distance "D" is 0.005 inch, but it is contemplated that other offsets may be suitable depending on the application, the size or configuration of the bladeset and the type of hair cutter. The top wall 64 also forms a "U"-shaped enclosure, having extensions 65 for preventing the moving blade from sliding out of position during adjustment.

To adjust the position of the moving blade 32 relative to the stationary blade 34 so that the desired offset is obtained, the user first loosens the fasteners 58 to allow the moving blade 32 to move rearward relative to the stationary blade 34, then places the bladeset 12 in the recess 16. The stationary blade toothed edge 38 is urged against the lower interior wall 62 until contact is made. As described above, the projections 24, 26 exert a biasing force against the stationary blade 34 to hold it in position. The loosened fasteners 58 allow movement of the moving blade 32 relative to the guide 52 in a direction normal to the direction of reciprocation. Once free to move, the blade 32 is urged forward until the toothed edge 36 contacts the top wall 64. The fasteners 58 are then retightened to maintain the desired offset positioning.

Alternatively, the user could assemble the bladeset 12 in the recess 16 by placing the stationary blade 34 by itself in the recess, then adding the guide 52 and the moving blade 32 as is known in the art. Finally, the fasteners 58 are inserted in the openings 56 but not tightened until the blade edges 36, 38 contact the first and second stops 62, 64 as described above.

Another feature of the present blade calibration gauge 10 is that an upper surface 66 of the base 14 is provided with a mounting point 67, preferably a plurality of linearly spaced clips 68 for a tool 70 used to adjust the fasteners 58. In the preferred embodiment, the tool 70 is a slotted or Philips screwdriver, however any type of blade tip is contemplated to correspond to the head of the fastener 58, as is well known in the art. The clips 68 are dimensioned to frictionally retain a shaft 72 of the tool 70. A handle 74 has two axially arranged sections 76 and 78, each having a different style of grip. Opposite a blade 80 is the section 76 having a relatively smaller diameter and provided with surface texturing such as knurling 82 for enhanced grip. Other types of surface texturing such as checkering or resilient plastic or rubberized materials are contemplated. The relatively smaller diameter section 76 is configured for rapid axial rotation, as when a user is starting a fastener, or removing an already loosened fastener. This configuration of the handle 74 promotes "spinning" or rapid axial rotation of the tool 70.

Adjacent to the relatively smaller diameter section 76 is the second section 78 configured for exerting relatively high torque on the shaft 72. At least two fins 84 project radially from the handle section 78 and are of sufficient size to facilitate the user exerting a twisting force for tightening the fasteners 58. While in the preferred embodiment the fins 84 are 180° apart from each other and are generally coplanar, it is contemplated that other orientations of the fins 84 would be suitable for providing the user with a way to exert tightening force or torque upon the fasteners 58. It is preferred that the two handle sections 76, 78 are oriented relative to each other to facilitate rapid movement of the user's hand from one to the other, particularly from the small diameter section 76 to the large diameter section 78. Accordingly, it will be seen that the present blade calibration gauge 10 provides a user with a way to consistently adjust hair cutter bladesets, so that the desired offset distance D can be easily and reliably obtained. Further, the present tool 70 allows rapid and positive tightening of the fasteners 58 once the blades 32, 34 are in proper position.

Figure 4:
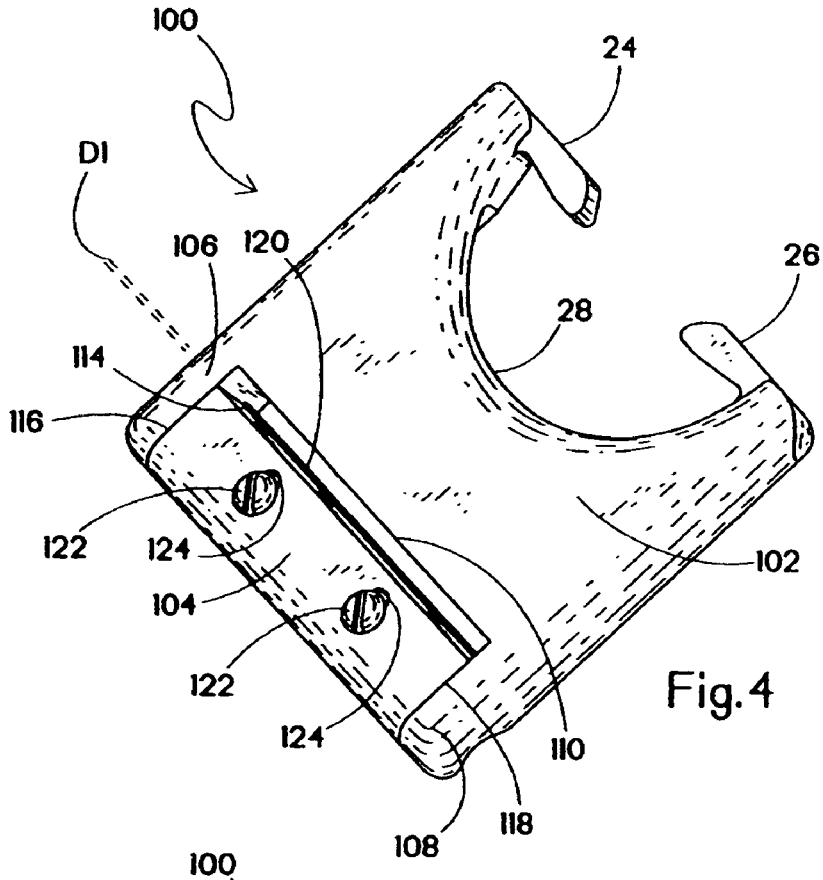
FIG. 4 is a bottom perspective view of an alternate embodiment of the present blade calibration gauge, showing an adjustable blade calibration gauge in a first desired spacing.
Figure 5:
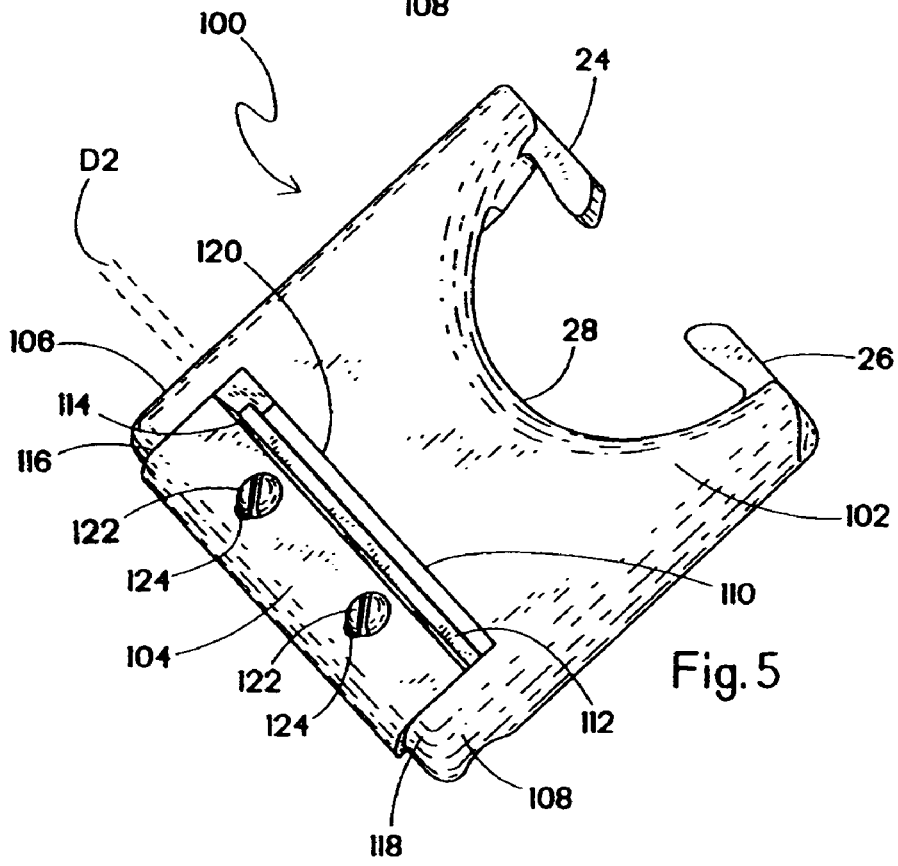
FIG. 5 is a bottom perspective view of an alternate embodiment of the present blade calibration gauge, showing an adjustable blade calibration gauge in a second desired spacing.

Referring now to FIGS. 4 and 5, an alternate embodiment of the present blade calibration gauge is shown and generally designated 100. A feature of the gauge 100 is that at least one of the first and second stops is adjustable relative to the other for varying the designated spacing between the first and second stops. In FIGS. 4 and 5, any feature not identified with a new reference number corresponds to the structure relating to the gauge 10.

In FIGS. 4 and 5, the adjustable blade calibration gauge 100 has a base 102 that includes a moving portion 104. The moving portion 104 is partially held within the base 102 by two guides 106 and 108. A base wall 110 is defined by the surface where guides 106 and 108 contact the base. The moving portion 104 has a planar upper face (not shown) that faces and slidably engages a planar surface 112 of the base 102 as shown in FIG. 5. The moving portion 104 has a moving internal wall 114 opposing the base wall 110, and two side edges 116 and 118 adjacent and slidingly engaging the guides 106 and 108.

Forming a first stop for the toothed edge 38 of the stationary blade 34, the moving internal wall 114 moves closer to, and farther away from the base wall 110 at the discretion of the user when the designated blade offset requires adjustment. The base 102 includes a fixed internal wall 120 that acts as a second stop for the toothed edge 36 of the moving blade 32 when adjustable blade calibration gauge 100 is in use. In the preferred version of the gauge 100, the fixed internal wall 120 is generally perpendicular to the planar surface 112.

When adjustment of the designated blade offset or desired spacing of the bladeset 12 is called for, the moving portion 104 is movable in a direction normal to the base wall 110 for adjusting the distance between the moving internal wall 114 (the first stop) and the fixed internal wall 120 (the second stop). Fasteners 122 project through elongate slots 124 that are normal to the moving interior wall 114 in the moving portion 104 and terminate in threaded bores (not shown) in the planar surface 112.

In FIG. 4, the adjustable blade calibration gauge 100 is shown in a first desired spacing generally corresponding to the spacing indicated in FIG. 3. When the bladeset 12 is placed into the base 102, the toothed edge 38 of the stationary blade 34 contacts the moving internal wall 114, and the toothed edge 36 of the moving blade 32 contacts the fixed internal wall 120, creating a desired spacing of D1 between the edges of the bladeset.

In FIG. 5, the adjustable blade calibration gauge 100 is shown in a second desired spacing. To retract the moving portion 104, the fasteners 122 are loosened and the moving portion is slid relative to the guides 106, 108 as well as the planar surface 112. Upon reaching the new desired spacing, the fasteners are tightened. When the bladeset 12 is placed into the base 102, the toothed edge 38 of the stationary blade 34 contacts the moving internal wall 114, and the toothed edge 36 of the moving blade 32 contacts the fixed internal wall 120, creating a desired spacing of D2 between the edges of the bladeset.

Preferably base 102 is provided with indicia (not shown) adjacent to the sliding portion 104 enabling the user to accurately select a desired spacing and more precisely position the sliding portion relative to the base. Alternatively, the base 102 could be configured so that the sliding portion 104 is located on the top side of the device, making the first stop (the corresponding to the toothed edge 36 of moving blade 32) adjustable. It is contemplated that either or both the first and second stops 114, 120 are adjustable.

While a particular embodiment of the present blade calibration gauge has been described herein, it will be appreciated by those skilled in the art that changes and modifications may be made thereto without departing from the invention in its broader aspects and as set forth in the following claims.

The invention claimed is:

1. A blade calibration gauge for a bladeset for a hair cutter, the bladeset having a moving blade laterally reciprocating relative to a stationary blade, the moving blade and the stationary blade being adjustable relative to one another in a direction normal to a direction of reciprocation, comprising:

a base defining a recess configured for receiving the stationary blade and providing a first stop for engaging a toothed edge of the blade; and a second stop on said base disposed on a common wall of said base and having a fixed offset relative to said first stop in the direction normal to the direction of reciprocation for providing a designated offset spacing for a toothed cutting edge of the moving blade relative to the corresponding toothed edge of the fixed blade.

2. The blade calibration gauge of claim 1 where the base has a first end configured for receiving the stationary blade and further includes a top portion provided with said first and second stops.

3. The blade calibration gauge of claim 2 where the distance between the first and second stops represents said designated spacing.

4. The blade calibration gauge of claim 1, wherein at least one of said first and second stops are adjustable relative to each other for varying said designated spacing.

5. The blade calibration gauge of claim 1 wherein said recess includes a floor configured for accommodating the stationary blade.

6. The blade calibration gauge of claim 1 further including a finger access opening for facilitating release of the stationary blade from said base.

7. The blade calibration gauge of claim 6 where said finger access opening is generally "D"-Shaped.

8. The blade calibration gauge of claim 1 further including a tool for adjusting fasteners securing the moving blade relative to the stationary blade, said tool having a handle with two axially arranged sections, each having a different style of grip, and wherein said base has a holder for said tool.

9. The blade calibration gauge of claim 8 wherein said holder includes a plurality of clips configured for frictionally retaining the tool, where said tool is a screwdriver having a handle with two axially aligned sections, each with a distinctive grip.

10. The blade calibration gauge of claim 1 further including a tool having a handle having at least two axially arranged sections, each handle section has a different style of grip, said first handle section is knurled and has a relatively smaller diameter forming a first of said styles of grip, and said second handle section has at least two fins projecting radially from said handle beyond said first section forming a second of said styles of grip, said first handle section is configured for rapid axial rotation and said second handle section is configured for exerting relatively high torque forces on said shaft.

11. The tool of claim 10 wherein, the tool is a screwdriver having a shaft connected to said handle and ending in a blade sized for fasteners used in removable bladesets.

12. The tool of claim 10 wherein said two axially arranged sections are disposed axially adjacent to each other for facilitating user hand movement from said first section enabling rapid axial rotation, to said second section, enabling exertion of relatively greater torque forces, and said fins are 180° apart from each other.

13. A blade calibration gauge for a bladeset for a hair cutter, the bladeset having a moving blade laterally reciprocating relative to a stationary blade, the moving blade and the stationary blade being adjustable relative to one another in a direction normal to a direction of reciprocation, comprising:

a base having two side sections facing one another connected by a top section, a recess defined between the side sections and the top section, said recess defined by two interior side walls and an interior top wall and having a floor portion between said interior side walls; and said interior top wall being defined by lower and upper surfaces offset from one another in a direction normal to a direction of reciprocation of the blades to define a respective desired offset of the stationary blade from the moving blade.

14. The blade calibration gauge of claim 13 further comprising at least one projection from a free end of each side portion on said base positioned to partially define said recess and provide a biasing force against the stationary blade positioned in said recess.

15. The blade calibration gauge of claim 13 wherein said floor portion is configured to receive the bladeset, stationary blade down, with a toothed edge of said stationary blade touching said lower surface of said interior top wall and the edge of said movable blade being adjustable so that it contacts said upper surface of said interior top wall.

16. The blade calibration gauge of claim 15 where said top section has a holder for a tool suitable to adjust fasteners connecting the moving blade to the stationary blade, said tool having a handle with two axially arranged sections, each having a different style of grip.

* * * * *